US008017213B2

(12) United States Patent
Sudre et al.

(10) Patent No.: US 8,017,213 B2
(45) Date of Patent: Sep. 13, 2011

(54) TEMPERATURE TOLERANT HOOKS FOR HOOK AND LOOP ATTACHMENT

(75) Inventors: Olivier H. Sudre, Thousand Oaks, CA (US); Janet B. Davis, Thousand Oaks, CA (US); Stanley A. Lawton, Clayton, MD (US)

(73) Assignee: The Boeing Company, Chicago, IL (US)

( * ) Notice: Subject to any disclaimer, the term of this patent is extended or adjusted under 35 U.S.C. 154(b) by 1779 days.

(21) Appl. No.: 11/379,677

(22) Filed: Apr. 21, 2006

(65) Prior Publication Data

US 2007/0245534 A1 Oct. 25, 2007

(51) Int. Cl.
*B32B 3/06* (2006.01)

(52) U.S. Cl. ..... 428/100; 428/97; 29/525.02

(58) Field of Classification Search ..... 428/100, 428/92–97, 99; 24/442, 444, 445, 450, 451, 24/452; 29/428, 525.01, 525.02
See application file for complete search history.

(56) References Cited

U.S. PATENT DOCUMENTS

| | | | | |
|---|---|---|---|---|
| 2,717,437 | A * | 9/1955 | De Mestral | 428/92 |
| 3,266,841 | A * | 8/1966 | Altman | 297/220 |
| 3,643,316 | A * | 2/1972 | Girard et al. | 148/516 |
| 4,380,092 | A * | 4/1983 | Brothers | 15/229.12 |
| 4,931,343 | A * | 6/1990 | Becker et al. | 428/95 |
| 5,429,875 | A * | 7/1995 | Okamoto et al. | 428/547 |
| 6,328,080 | B1 * | 12/2001 | Winters | 139/388 |
| 6,742,227 | B2 * | 6/2004 | Ulicny et al. | 24/442 |

* cited by examiner

*Primary Examiner* — David P Bryant
*Assistant Examiner* — Christopher M Koehler
(74) *Attorney, Agent, or Firm* — Law Office of Charles W. Peterson, Jr.

(57) ABSTRACT

A temperature tolerant hook and loop attachment, a method of forming a sheet of the hooks and, a method of insulating the skin of a flight vehicle. Temporary loops are formed in a fabric containing temperature tolerant fiber tows, e.g., the tows may be carbon, a metal, a carbide such as carbon silicide, a nitride, or an oxide. The temporary loops are stiffened (e.g., with resin, metal or ceramic), and severed to form temperature tolerant fiber composite hooks. The sheet may be cut and permanently applied, for example, to the skin of a spacecraft or aircraft. A fibrous material, e.g., fibrous insulation or batting, may be pressed in place or formed into the hooks, or the fibrous material may be attached to another structure and pressed in place for a temperature tolerant hook and loop attachment.

12 Claims, 5 Drawing Sheets

TEMPERATURE TOLERANT HOOKS FOR HOOK AND LOOP ATTACHMENT

BACKGROUND OF THE INVENTION

1. Field of the Invention

The present invention generally relates to high temperature fasteners and more particularly to hooks for a hook and loop attachment in high temperature environments.

2. Background Description

Spacecraft, such as the space shuttle, hypersonic air-breathing vehicles, and even some state of the art aircraft, are subjected to temperature extremes, e.g., when leaving and re-entering the atmosphere. The skin of a hypersonic vehicle, for example, reaches temperature extremes in excess of 3000° F. (1650° C.) from skin friction and shockwave formation. In the case of space vehicles, very low temperatures are encountered in orbit while extreme, high temperatures (e.g., in excess of 1600° C.) are encountered in re-entry. Typically, very low-density, high-temperature insulation is used either inside (e.g., in the passenger cabin and cargo bays) or outside the vehicle (e.g., space shuttle blankets and tiles) to insulate spacecraft components and structure from these extreme temperatures. Insulation also may be used as a heat barrier between the engines and the vehicle structure and components.

Insulation is typically attached using silicone adhesives. Unfortunately, while a typical state-of-the-art silicone resin adhesive may work well below 500° F. (260° C.), these state-of-the-art silicone adhesives fail at higher temperatures. In-flight adhesive failure for externally mounted insulation can lead to catastrophic vehicle failure within seconds. Consequently, it may be necessary to use mechanical fasteners to mount the high-temperature insulation and hold it in place. In a typical spacecraft, where payload weight costs are high, cumbersome mechanical fasteners can increase vehicle weight. Moreover, both of these approaches, using state-of-the-art adhesives or mechanical fasteners, can be labor intensive (i.e., costly) to install and installation errors are difficult to correct. Further, failures are equally difficult/costly to repair.

Thus there is a need for a lightweight, high-temperature fastener that is simple to install and maintain and especially for a lightweight, high-temperature fastener for use in hypersonic and reusable space vehicles.

SUMMARY OF THE INVENTION

An embodiment of the present invention simplifies high temperature insulation installation and repair, while minimizing added weight to the high temperature insulation, e.g., in hypersonic and reusable space vehicles. Further, an embodiment of the present invention provides a very low thermal conductivity bond between the insulation and the structure, as well as a method to attach material and structures with different thermal expansion behaviors.

In particular, embodiments of the present invention include a high temperature hook and loop attachment, a method of forming a sheet of the hooks and, a method of insulating the skin of a flight vehicle. Tows of high-temperature fibers are woven into a fabric and temporary loops are formed with some of the tows using a well-known state-of-the art weaving process. For rigidity, the fabric is infiltrated with a stiffener (also known in the art of composite processing as a matrix) using any suitable technique known in the art of composite material fabrication to form stiffened or composite loops. These temporary loops are cut to form stiffened or composite hooks. Then the rigid sheet may be cut and permanently applied to, or incorporated into for example, to the skin of a spacecraft or aircraft.

A sheet can be mounted inside a high temperature skin (e.g., carbon/carbon composite) for attaching insulation to block heat conduction from the skin to the interior of the vehicle. Alternately, a sheet can be mounted on the outside of a lower temperature skin (e.g. aluminum or polymer composite), to attach external insulation to block conduction of aerodynamic heat to the skin. A fibrous material, e.g., fibrous insulation or batting, may be pressed in place or the fibrous material may be attached to another structure and pressed in place for a high temperature hook and loop attachment. Alternately, the insulation can be directly deposited onto the hook structure. The resulting composite hook structure has a relatively high strength, to provide a heat resistant hook of a Velcro®-like hook-and-loop fastener. The insulation can be ripped apart for removal and re-installed or replaced by a new insulation.

Advantageously, a sheet of preferred high temperature hooks may be used for almost any semi-permanent attachment application, wherever a hook and loop fastener may be used, regardless of local ambient temperature or temperature extremes. In particular, embodiments of the present invention have application to attaching insulation to the skin of a spacecraft or aircraft that may be subjected to temperatures well above 3000° F. (1650° C.) or below 500 F (260° C.). Further, a preferred high temperature hook sheet adds little or no additional weight beyond that of the attached loops, i.e., the fibrous insulating material, and serves to further block thermal conduction and limit the effects of thermal expansion mismatch.

BRIEF DESCRIPTION OF THE DRAWINGS

The foregoing and other objects, aspects and advantages will be better understood from the following detailed description of a preferred embodiment of the invention with reference to the drawings, in which.

DESCRIPTION OF PREFERRED EMBODIMENTS

Figure 1:
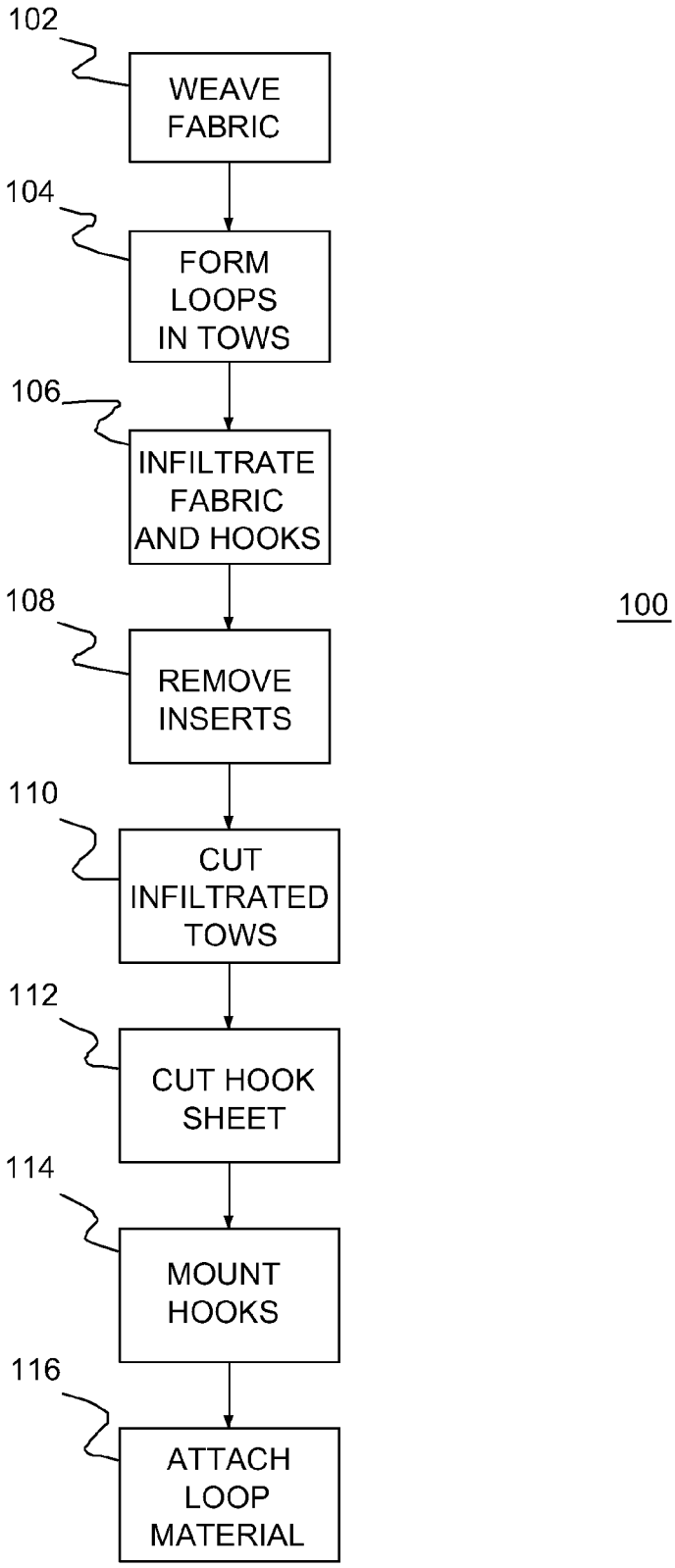
FIG. 1 shows an example of a method of forming sheets of high temperature fasteners according to a preferred embodiment of the invention.

Turning now to the drawings, and more particularly, FIG. 1 shows an example of a method of forming sheets of small fiber composite hooks as temperature tolerant fasteners according to a preferred embodiment of the present invention. In particular, a suitable insulation may be attached to the sheets or portions of the sheets in an arrangement analogous to a Velcro®-type hook-and-loop fastener or touch fastener arrangement. First, in step 102 fiber tows (carbon, carbide, nitride, oxide, or composition suitable for the particular application) are woven into a fabric, such that the fiber tows may form rows of loops. These loops may be directly formed as the fabric is woven or, alternately, subsequently added using a process similar to stitching. In this example, temporary loops are formed on one side of the fabric. The spacing of the fiber tows (array of columns) and rows of temporary loops is selected for the particular application as described in more detail herein below. In step 104, the array of temporary loops are formed. The temporary loops may be formed, for example, by inserting rods of sufficient diameter or of a specific shape at the desired spacing during weaving, or the rods may be inserted after weaving the fabric. If loops form with a suitable natural shape, rod insertion may be unnecessary. Next in step 106, a matrix suitable for use as a stiffener or a stiffening agent is infiltrated between the fibers using any material typically used in composite manufacturing. The type of stiffener (i.e., the matrix) is selected according to the requirements of the particular application. For low temperature applications (e.g., 500° F./260° C. and below) a resin may suffice as a stiffening agent. Preferably, however, the stiffening agent is a metal or ceramic that is capable of withstanding higher temperatures. Then, in step 108 the rods are removed. In step 110 the stiffened temporary loops are cut such that an array of hooks are formed. Once the hooks have been formed, the rigid sheet may be cut to size in step 112 for a particular application, e.g., like cutting a stencil. In step 114 the cut sheet may be mounted to a permanent position, e.g., mechanically attached to the skin. Finally, in step 116 a fibrous blanket, e.g., of insulation material, is pressed in place with the hooks penetrating the fibrous blanket to grasp it and hold it in place, again analogous to a Velcro®-type hook-and-loop fastener arrangement.

Alternately, the stiffening agent can be a temporary material that stiffens sufficiently the loops to be able to proceed in steps 106, 108 and step 110. In that case, a permanent high temperature matrix material is infiltrated after cutting in step 110. This alternate approach is advantageous for protecting cut fiber ends from external environmental conditions. In one preferred embodiment, the hook sheet is part of a composite skin. The fabric with the loops and with or without mandrels or inserts are added to the composite skin after skin lay-up and the whole assembly is processed together to infiltrate the matrix. The composite skin fabrication concludes with steps 108 and 110.

Thus, the small fiber composite hooks on a preferred composite sheet provides a quick and simple mechanism to attach, release and reattach temperature tolerant insulation blankets to a structure, such as hypersonic vehicles or reusable space vehicles. Tows woven within the fabric are formed according to a desired shape, position and hook size. The matrix and the temporary fiber tow loops are infiltrated either with a stiffening agent, e.g., resin (for low temperature applications or for temporarily shaping the loop) or with temperature tolerant material (metal or ceramic) using a suitable liquid or vapor-based technique such as are known in the composite material fabrication arts. Hence the temporary loops are co-processed with the fabric structure and, advantageously, with the composite structure of the vehicle itself. Subsequently, the temporary loops are cut to form hooks that may be used in combination with typical insulation blanket material, commonly used in insulation applications or with woven fabric shells. The size, shape and strength requirements for the hooks are determined by the type of insulation, i.e., the nature of the "loop" material to which they are attached. Preferably, the loop material is a fibrous insulation material such as a ceramic blanket or ceramic felt mat.

Figure 2A:
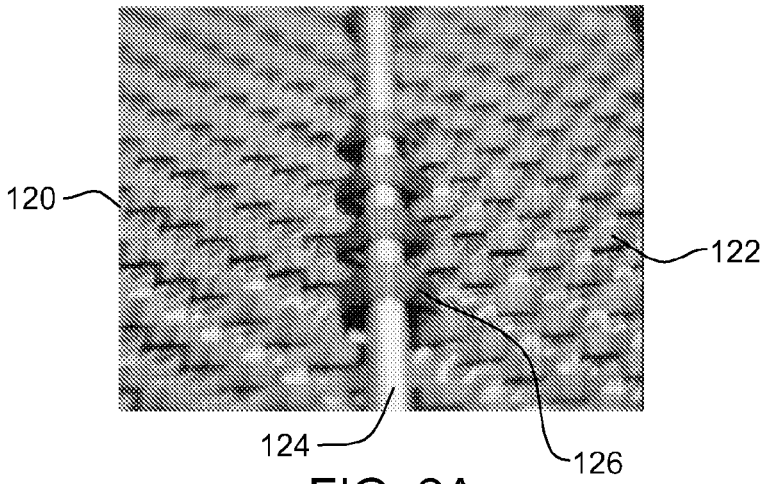
FIGS. 2A-B show an example of an isotropic view of a section of woven material with composite fiber tows of different temperature tolerant material.
Figure 2B:
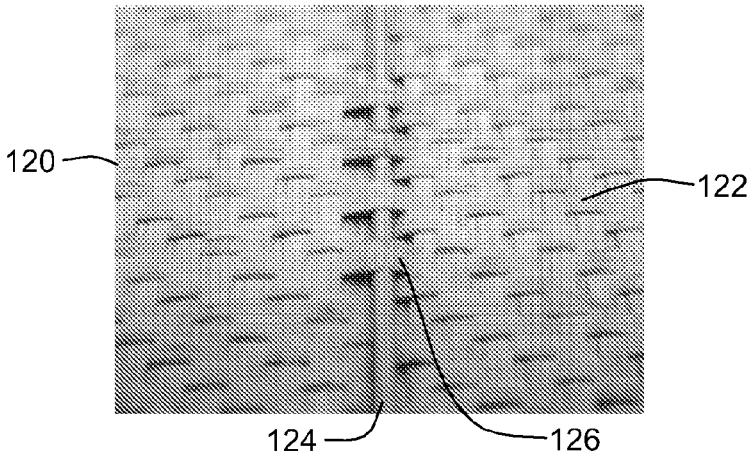

FIGS. 2A-B show an example of an isotropic view of a section of woven fabric preform 120 with fiber tows 122. FIG. 2A shows rods 124 form temporary loops (i.e., uncut hooks) 126 in ceramic (i.e., silicon carbide in this example) fiber tows 122, e.g., after forming loops in tows in step 104 of FIG. 1. The size of the finished hooks is determined by several factors. The size is selected to be as small as possible to limit the relative movement between the hook and loop layers. However, small hooks are more difficult to prepare because small temperature tolerant fibers tend to break when shaped around a small radius of curvature. So, the minimum radius of curvature depends on the nature and diameter of the temperature tolerant fibers. In this example, the rods 124 are 0.125 inches (0.32 cm) in diameter. FIG. 2B shows the fabric 120 and temporary loops 126 after infiltrating a silicon carbide matrix in step 106 and prior to removing the rods 124.

Figure 3A:
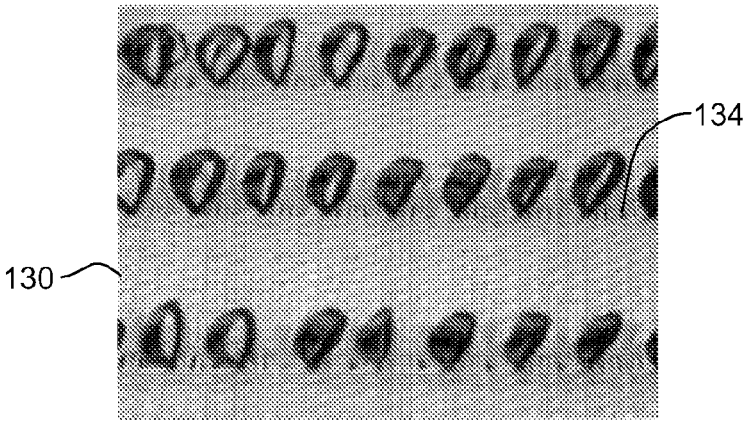
FIGS. 3A-B show forming hooks in material from temporary loops that remain after removing the rods.
Figure 3B:
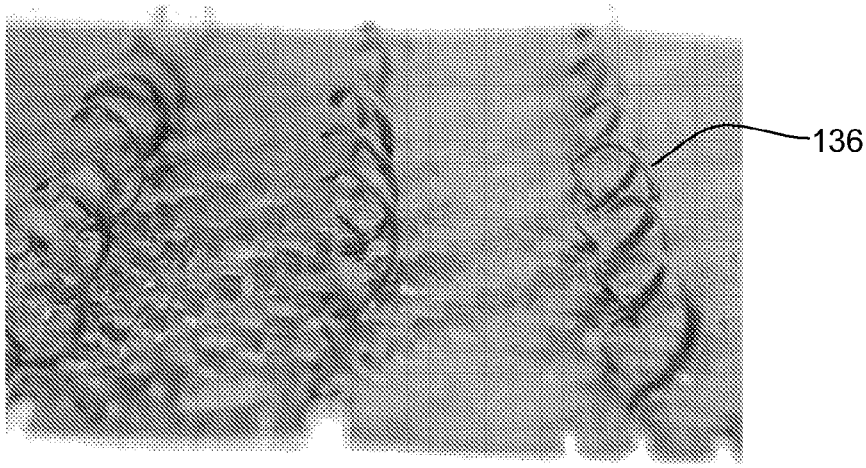

FIGS. 3A-B show forming hooks in material 130 from temporary loops in carbon. FIG. 3A shows temporary loops in carbon and aluminosilicate fiber tows 134, which remain after removing the rods in step 108 of FIG. 1. FIG. 3B shows a close-up view of an array of formed stiffened hooks 136 after cutting in step 110 of FIG. 1. In this example, loops are formed in carbon only tows using rods with a rectangular cross-section to form hooks with a different shape and size. The fabric may be of any suitable material including, ceramic, glass or metal or of the same material as the fiber tows 122, 134. Preferably for high temperature applications, however, the fabric is made of carbon and ceramic fibers.

Figure 4A:
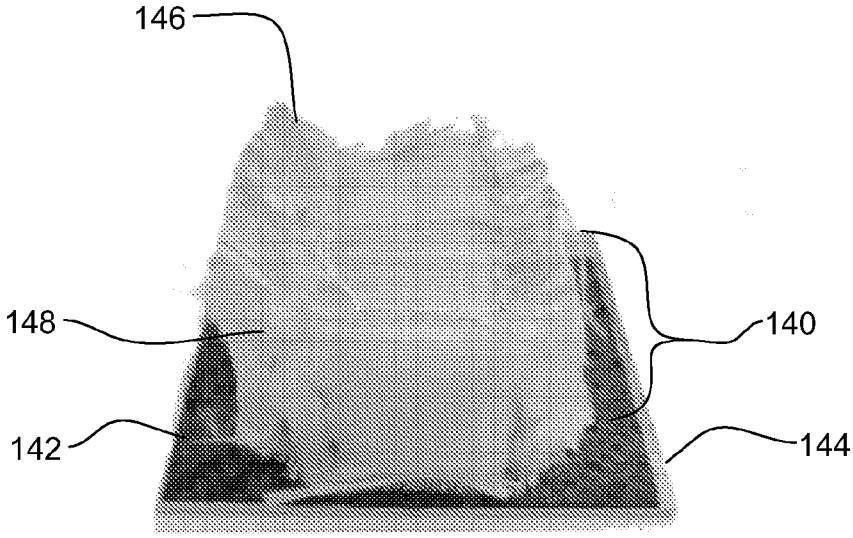
FIGS. 4A-B show examples of loop samples attached to a cut sheet and interlocked in a hook-and-loop configuration.
Figure 4B:
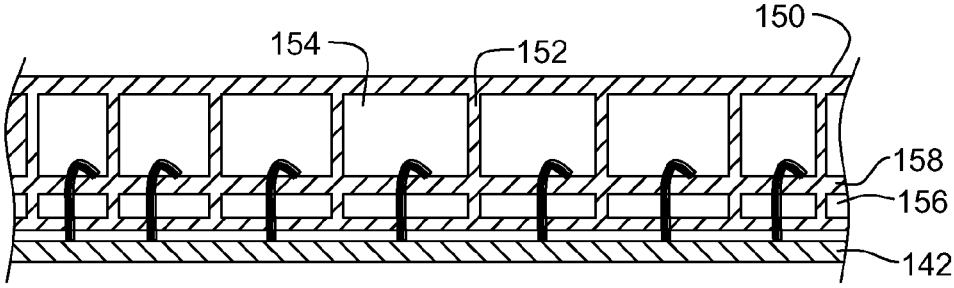

FIGS. 4A-B show examples of loop samples attached to a cut sheet and interlocked in a hook-and-loop configuration, e.g., in step 116 of FIG. 1, analogous to any typical low temperature hook-and-loop attachment. In the example of FIG. 4A a section of an insulating blanket 140 is attached to a rigid sheet 142 (the hook side) fixed to a surface, e.g., plate 144. The rigid sheet 142 is covered with an array of rigid hooks (in the insulating blanket 140). The insulating blanket section 140 (the loop side) includes randomly oriented fibers forming a core insulating felt mat with an outer fabric 146 on either side of batting 148. The top and bottom fabric layers 146 are stitched through the fiber mat core in this example. Depending on the shape and strength of the hooks, the insulation (blanket section 140) can be pressed into the hook with the fabric and/or mat forming the loop side. Optionally, the loop side (insulating blanket 140) may include a woven fabric with small loops or a thin insulation of randomly oriented entangled fibers. For applications where the loops (e.g., insulation) are of a material that it is too difficult for the hooks to pierce through the loop surface, the loop surface may be pierced regularly such that small slits and/or "button holes" form in the fabric bottom, preferably at intervals that match the hook pattern of the rigid sheet 142 to facilitate hooking. Although shown here with the insulating blanket 140 including a fabric backing 146, this is for example only and not intended as a limitation. Alternately, the insulating blanket 140 may be simply a layer of batting 148 with no fabric backing 146.

FIG. 4B shows a cross sectional example of a chambered insulation assembly 150 attached to rigid sheet 142 for a stronger loop backing attachment than with the plain insulation material backing 140 of FIG. 4A. In this example, the chambered insulation assembly 150 has fabric chamber casings 152 defined by layers of fabric and includes of two layers of insulation 154 and 156 sandwiched between and separated by the fabric layers 152, 158. The fabric chamber casings 152 may be made from a distance weave fabric or by stitching individual fabric layers together. The chambered insulation 154, 156 may any suitable insulation and, of a single insulation type or, for example, two different types such as ceramic batting 154 and an aerogel 156. The chambered insulation assembly 150 may be attached to the rigid sheet 142 by pressing it onto the hooks. Thus, the intermediate fabric layer 158 can provide a stronger loop backing than plain insulation material 140.

Figure 5A:
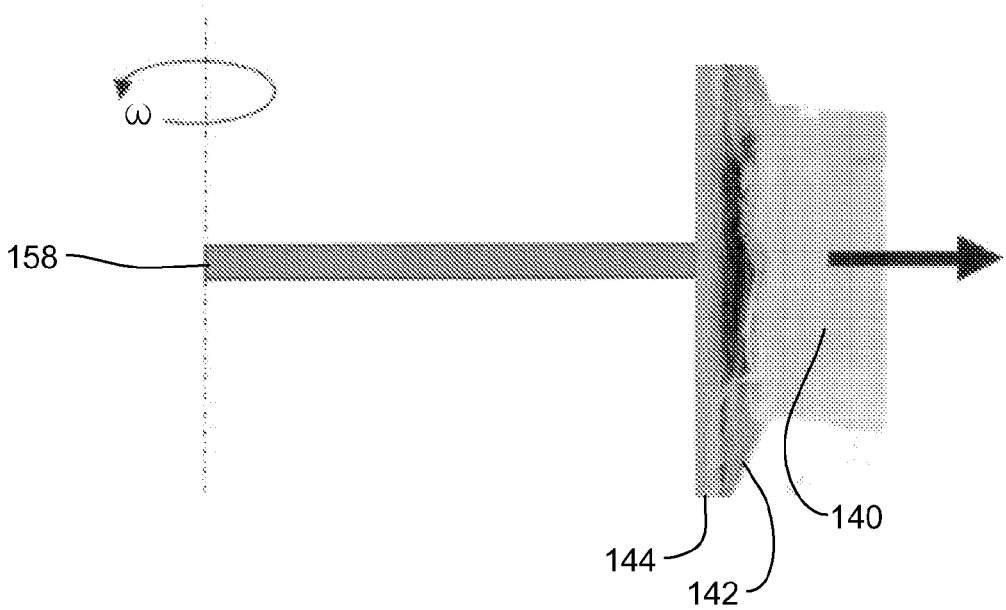
FIGS. 5A-B show a test fixture with a sample of the stiffened hooks and insulating blanket and a plot characterizing holding force and hook density derived using the test fixture.
Figure 5B:
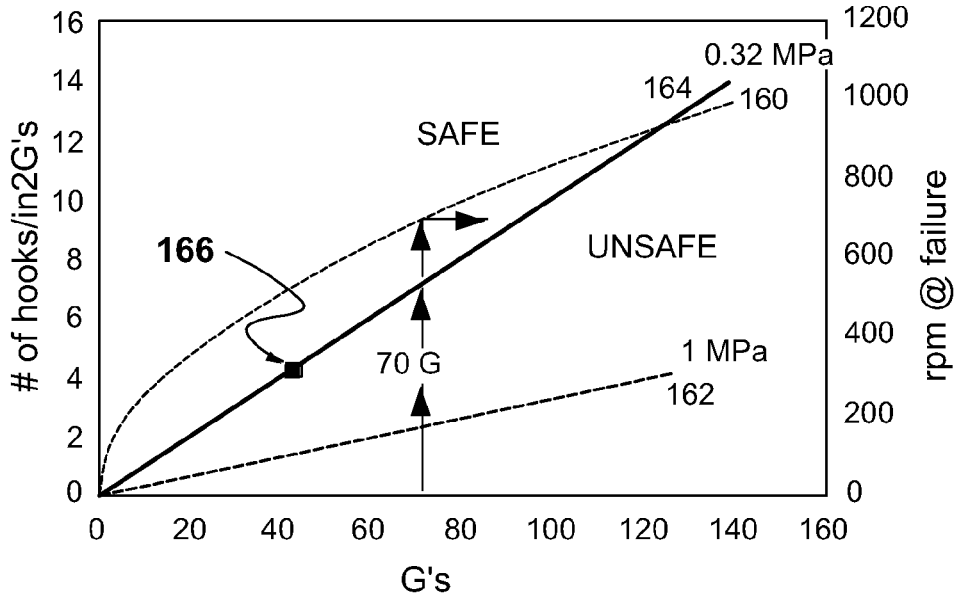

FIGS. 5A-B show a hook and loop test fixture with a sample rigid sheet 142 of the composite hooks and insulating blanket 140 (loops) of FIG. 4A attached to plate 144 and a plot characterizing holding force and hook density. In this example, the blanket has a density of 160 kilograms per cubic meter (160 $kg/m^3$), which for a 1 inch (2.54 cm) thick blanket adds a per unit area mass (M) of 4 $kg/m^2$. The hook layer 142 and the insulating blanket 140 of the test sample were attached at plate 144 to centrifuge arm 158 with a length (R) of 5 inches (0.127 m) and the centrifuge was spun at an angular speed ($\omega$, where the centrifuge has a rotational frequency f in revolutions per minute (rpm), and $\omega=(2\pi f/60)$).

FIG. 5B shows the relationship (curve 160) between the G-force on the blanket (e.g., 140) to the rotation ($\omega$) of the centrifuge in radians per second, which may be expressed according to the relation ship $Gs=R\omega^2/g$, where $g=9.81\ m/S^2$ is the gravitational constant. Necessary hook density (N) measured in #hooks/$m^2$ for a particular application may be determined, e.g., using the arrangement of FIG. 4A, taking the hook-to-loop blanket strength ($\sigma$) measured in $kg*m/s^2/m^2$, for a blanket having an area (($\alpha$) in $m^2$) according to $N=MR\omega^2/\sigma\pi\alpha^2$, which is plotted in hooks/$in^2$ (1/1550 hooks/$m^2$) in curve 164 for a hook strength of 0.32 MPa as a function of Gs. The hook density is sufficient to resist a given G-force above curve 164, and inadequate below 164 and it is apparent that for survival to 70 Gs the hook density must be at least 8 hooks/$in^2$ (1.24 hooks/$cm^2$). So, typically, since attaching/removing the loop material becomes more difficult as hook density increases, hook density may be selected to be minimal for a particular application for ease of attachment/removal. Curves 162, 164 show a comparison of hook density verses Gs for $\sigma$=1 MegaPascal (1 MPa) and 0.32 MPa, respectively. Further, the attachment between hook sheet 142 and insulation 140 was tested by spinning the centrifuge (not shown) from zero to 700 rpm for 70 Gs of force. The attachment showed some edge delamination at 400 rpm and failed at point 166 on curve 164 at about 550 rpm (~40 Gs). Therefore, a preferred hook and loop attachment system can meet a targeted survival force, 70 Gs, by either increasing the hook density above that for this sample 142 to 8 hooks/$in^2$ or, by increasing the hook-to-loop attachment strength to 1 MPa or above.

Figure 6:
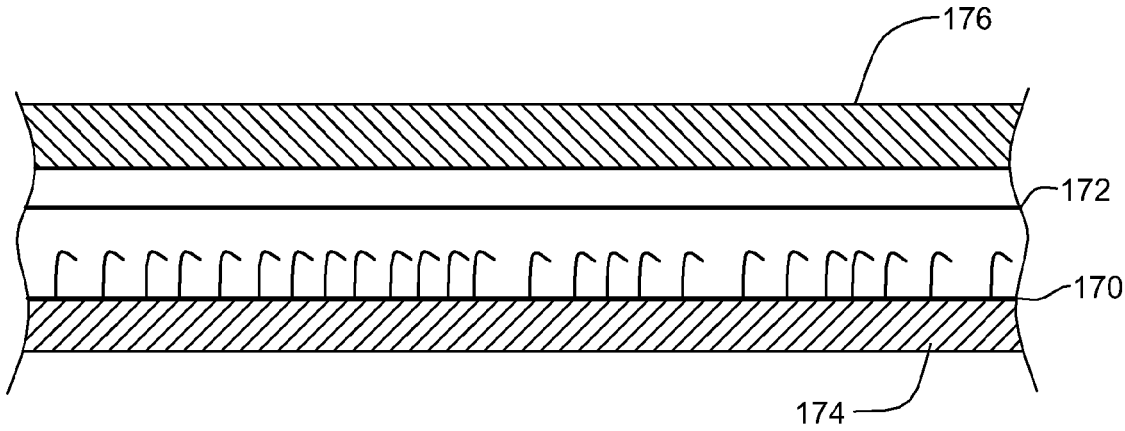
FIG. 6 shows a cross sectional example, wherein the preferred stiffened hook layer and blanket are used for permanently or temporarily attaching one structure to another.

FIG. 6 shows a cross sectional example, wherein the preferred stiffened hook matrix 170 and blanket 172 are used for permanent or temporary attachment to attach one structure 174 to another 176. This type of temperature tolerant attachment is analogous to well-known uses for permanently or temporarily mating two bodies using Velcro®.

Advantageously, a sheet of preferred temperature tolerant hooks may be used for almost any permanent or temporary attachment application, wherever a hook and loop fastener may be used, regardless of local ambient temperature or temperature extremes. In particular, the present invention has application to attaching insulation to the skin of a spacecraft or aircraft that may be subjected to temperatures well above 500° F. (260° C.). The preferred embodiment temperature tolerant hook sheets add little or no additional weight. Further, because the preferred embodiment temperature tolerant hook sheets provide a minimal thermal path to the structure, the insulation capacity is further increased.

While the invention has been described in terms of preferred embodiments, those skilled in the art will recognize that the invention can be practiced with modification within the spirit and scope of the appended claims. It is intended that all such variations and modifications fall within the scope of the appended claims. Examples and drawings are, accordingly, to be regarded as illustrative rather than restrictive.

We claim:

1. A temperature tolerant attachment for semi-permanently attaching fibrous material to a surface, said temperature tolerant attachment comprising:
- a composite material layer;
- a plurality of temperature tolerant hooks extending from at least one surface of said composite material layer;
- a fibrous loop material, said fibrous loop material attaching to said plurality of temperature tolerant hooks in a hook and loop fastener arrangement; and
- an insulating blanket of said fibrous material, said fibrous material being said fibrous loop material, said insulating blanket being attached to said surface, said insulating blanket comprising:
  - a core insulating felt mat of randomly oriented fibers, said randomly oriented fibers including said fibrous loop material;
  - an outer fabric layers on either side of said batting; and
  - stitching through said outer fabric layers and the felt mat core.

2. A temperature tolerant attachment as in claim 1, wherein said composite material layer comprises a fabric and a ceramic matrix.

3. A temperature tolerant attachment as in claim 2, wherein said fabric is a fiber preform and includes a plurality of temperature tolerant fiber tows woven in said fiber preform, each temperature tolerant hook being in a segment of one temperature tolerant fiber tow.

4. A temperature tolerant attachment as in claim 3, wherein each said segment includes an infiltrated stiffening agent.

5. A temperature tolerant attachment as in claim 3, wherein said each temperature tolerant hook is a severed temporary loop in said one temperature tolerant fiber tow, said temporary loop being a 0.125 inch (0.32 cm) loop of said temperature tolerant fiber tow.

6. A temperature tolerant attachment as in claim 3, wherein said fiber preform is a preform of temperature tolerant fibers selected from the group of materials consisting of carbon, ceramic, glass and metal.

7. A temperature tolerant attachment as in claim 6, wherein the preform temperature tolerant fibers and the fiber tows are of the same material selected from the group of materials consisting of a carbide, a nitride and an oxide.

8. A temperature tolerant attachment as in claim 7, wherein said temperature tolerant fiber tows comprise carbon.

9. A temperature tolerant attachment as in claim 8, wherein said temperature tolerant fiber tows are silicon carbide tows.

10. A temperature tolerant attachment as in claim 7, wherein said temperature tolerant fiber tows are an oxide.

11. A temperature tolerant attachment as in claim 7, wherein said temperature tolerant fiber tows are metal tows.

12. A temperature tolerant attachment as in claim 1, said insulating blanket further comprising slits through at least one of said outer fabric layers, said temperature tolerant hooks extending through said slits and into said core insulating felt.

* * * * *